US008979410B2

(12) United States Patent
Massimi

(10) Patent No.: US 8,979,410 B2
(45) Date of Patent: Mar. 17, 2015

(54) INFANT TOOTHBRUSH AND METHOD

(76) Inventor: Priscilla Johanna Massimi, Golden's Bridge, NY (US)

( * ) Notice: Subject to any disclaimer, the term of this patent is extended or adjusted under 35 U.S.C. 154(b) by 837 days.

(21) Appl. No.: 13/134,659

(22) Filed: Jun. 14, 2011

(65) Prior Publication Data

US 2012/0318288 A1 Dec. 20, 2012

(51) Int. Cl.

| | |
|---|---|
| ***A46B 11/02*** | (2006.01) |
| ***A46B 3/20*** | (2006.01) |
| ***A46B 11/00*** | (2006.01) |
| *A46B 3/00* | (2006.01) |

(52) U.S. Cl.

CPC ..... *A46B 11/0041* (2013.01); *A46B 3/005* (2013.01); *A46B 2200/1066* (2013.01)

USPC ..... 401/185; 401/156; 15/167.2

(58) Field of Classification Search

CPC ..... A61J 9/005; A46B 11/0079

USPC ..... 401/152, 156, 183, 184, 185

See application file for complete search history.

(56) References Cited

U.S. PATENT DOCUMENTS

| | | | | |
|---|---|---|---|---|
| 2,743,042 | A * | 4/1956 | Burgin | 222/191 |
| 3,734,106 | A * | 5/1973 | Zimmerman | 132/311 |
| 5,711,759 | A * | 1/1998 | Smith et al. | 601/139 |
| 5,729,859 | A * | 3/1998 | Guffin, III | 15/167.1 |
| 5,765,252 | A | 6/1998 | Carr | |
| 6,334,231 | B2 * | 1/2002 | Safieh | 15/167.1 |
| 6,536,979 | B1 | 3/2003 | Kenny et al. | |
| 6,602,013 | B2 * | 8/2003 | Clark | 401/282 |
| 6,679,642 | B1 * | 1/2004 | Dillingham et al. | 401/184 |
| 6,715,952 | B1 | 4/2004 | Aiken et al. | |
| 7,651,291 | B2 * | 1/2010 | Py et al. | 401/188 R |
| 2001/0009048 | A1 | 7/2001 | Safieh | |
| 2003/0095828 | A1 * | 5/2003 | Hofstedt | 401/277 |
| 2004/0006874 | A1 * | 1/2004 | Kamm et al. | 30/141 |
| 2007/0277338 | A1 | 12/2007 | Takeuchi et al. | |

* cited by examiner

*Primary Examiner* — David Walczak

*Assistant Examiner* — Joshua Wiljanen

(74) *Attorney, Agent, or Firm* — Gregor N. Neff

(57) ABSTRACT

The toothbrush has a base support structure shaped like a nipple, with brush bristles extending from the nipple. A flexible bulb containing liquid is secured to the support structure with a passageway in the support structure leading to holes exiting in the brush. The brush is used to brush the teeth of the infant, and liquid is squeezed from the bulb to rinse the infant's teeth and mouth when cleansing is complete. Preferably, the brush bristles extend most or all of the way around the nipple to facilitate brushing. A valve operates to prevent the flow of liquid from the bulb until squeezed by the infant's caregiver, thus minimizing leakage.

9 Claims, 2 Drawing Sheets

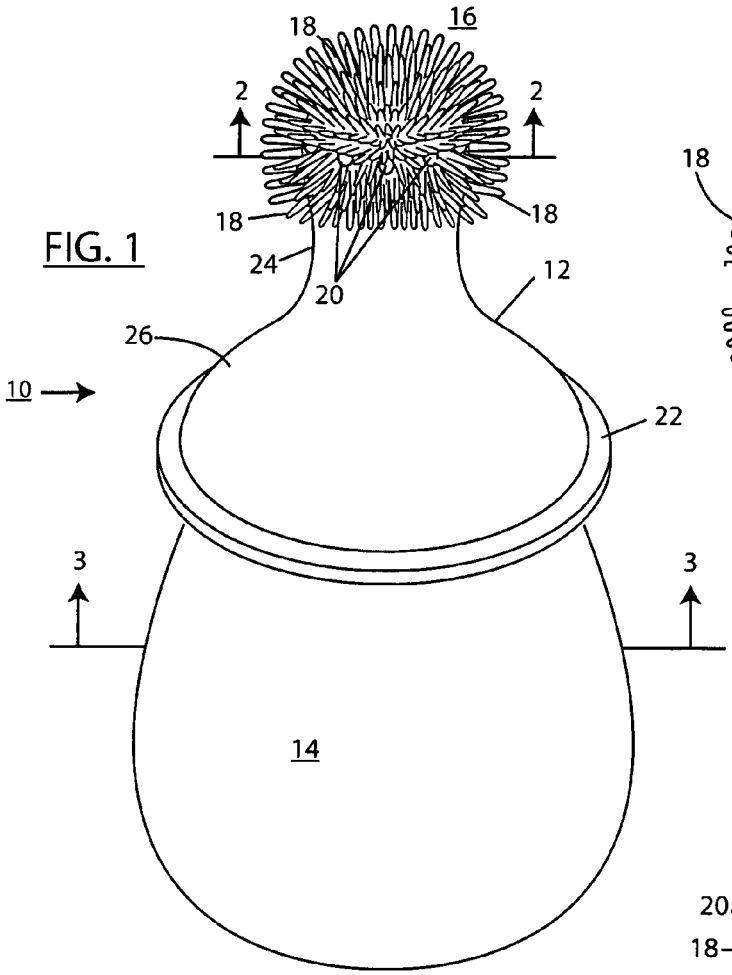
FIG. 1
FIG. 2
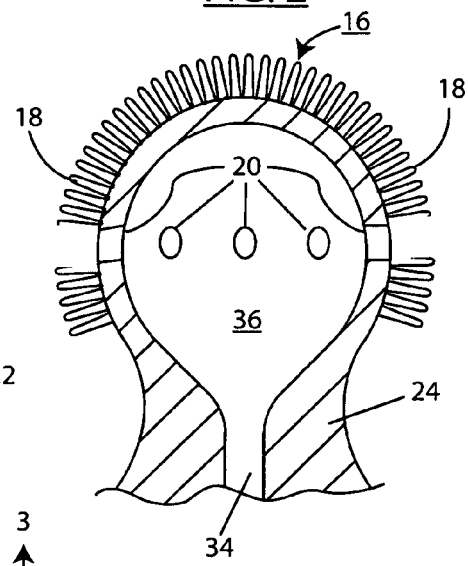
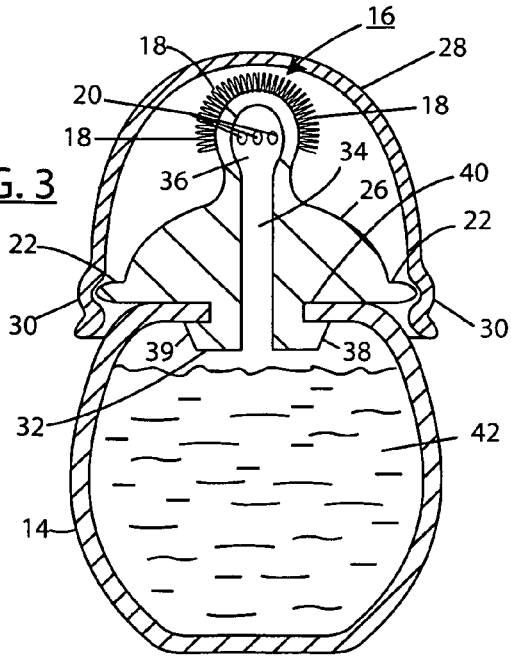
FIG. 3

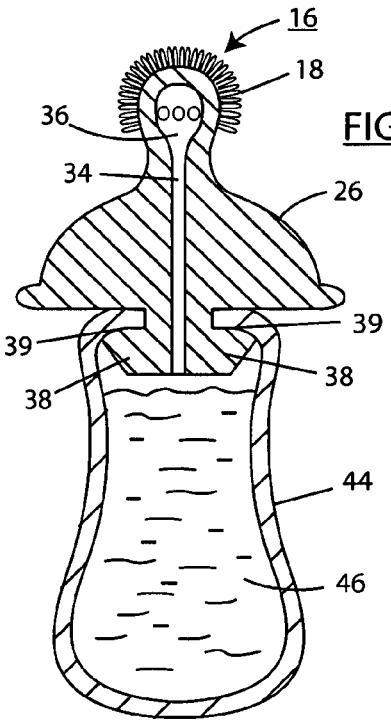
FIG. 4
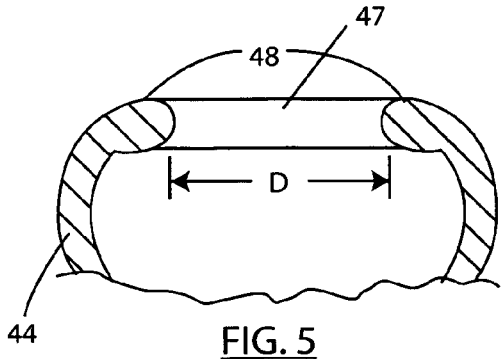
FIG. 5
FIG. 6
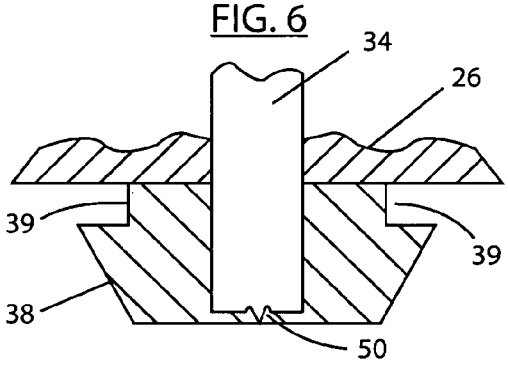
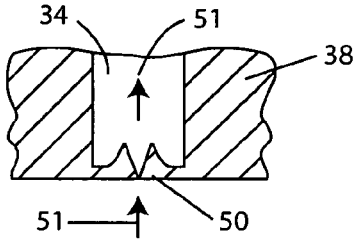
FIG. 8
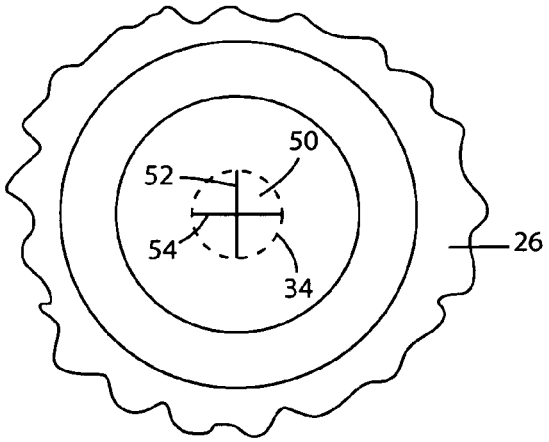
FIG. 7

INFANT TOOTHBRUSH AND METHOD

This invention relates to devices and methods for brushing and cleansing the teeth of infants.

When the first teeth of infants emerge (usually at an age around 6 months or so), the teeth should be brushed in order to prevent decay and infection before the baby teeth fall out and are replaced by adult teeth.

Brushing the teeth of infants often is troublesome and difficult, for a number of reasons. One of the main reasons is that the infant is uncomfortable with the unfamiliar feel of a toothbrush in his or her mouth and does not allow tooth brushing without squirming and other forms of protest.

Although the available designs vary, a common form of infant toothbrush is one which is worn on the finger of the caregiver, more or less like a thimble.

It is believed that the finger with a brush on it is unfamiliar to the infant and causes discomfort and protest by the infant. This makes it difficult to do a good job in cleansing the teeth.

Applicant also has recognized that the teeth of the infant should be rinsed to remove dentifrice and other coatings which may remain on the infant's teeth after brushing. At the present time, rinsing is a difficult task for the caregiver. The caregiver must obtain a cup or other container of water and pour the water into the infant's mouth with one hand while trying to keep the infant's mouth open with the other hand, all making for a difficult and cumbersome operation.

Therefore, it is an object of the invention to provide an infant toothbrush and cleansing method which eliminate or alleviate the foregoing problems.

Specifically, it is an object of the invention to provide an infant toothbrush which is shaped like an object familiar to the infant so as not to create undue protest, and to permit better cleansing.

It is another object of the invention to provide such a toothbrush with which is relatively easy to position the bristles against the tooth or teeth of the infant, despite squirming or other movement of the infant.

It is a further object of the invention to provide such a toothbrush which is relatively easy and inexpensive to manufacture, easy to handle with one hand, and effective in cleaning the infant's teeth.

It is a still further object of the invention to provide a means for relatively easily rinsing the infant's mouth after brushing to remove unwanted residue from the brushing.

It is another object of the invention to provide such a device which is portable and can be safely carried in the purse or pocket of the caregiver so that the teeth can be brushed easily when away from the infant's home; a device which is sanitary to carry and resistant to leakage.

It is yet another object of the invention to provide such a device which easily can be disassembled for thorough cleaning.

In accordance with the present invention, the foregoing objects are met by the provision of an infant toothbrush with a nipple-shaped brush support structure with bristles on the tip of the nipple. The support structure has a hollow passageway and holes exiting the passageway in the vicinity of the bristles. A flexible compressible bulb is securely attached to the support structure, and is filled with water or other hygienic liquid for use in wetting the brush and rinsing the infant's mouth.

Preferably, the bristles on the nipple are wider than usual; they extend approximately at least half way around the circumference of the nipple, and preferably all the way around the nipple. This provides maximum scrubbing surface area available to brush the tooth or teeth of a squirming infant, and alleviates the difficulty in having only a narrow brush which is relatively difficult to manipulate into proper position.

The bulb is attached to the base portion with its interior in communication with the passageway through the base portion. Preferably, the attachment means is quick and easy to use by simply pressing the upper lip of the bulb against a closure projection extending from the bottom of the base member so that the bulb can be removed from the base member with a simple pull, and can be replaced simply by pressing the two elements together.

Preferably, a tight-fitting cap fits over the exterior of the brush so as to protect and keep it sanitary when it is carried in a pocket or purse.

Also, it is preferable that a simple valve be positioned in the passageway through the toothbrush to prevent the flow of liquid from the bulb through the passageway until a certain predetermined minimal pressure is applied to the bulb, thus keeping the liquid from being dispensed into the passageway until it is desired to do so. When dispensing is desired, hand pressure is applied to the bulb. This valve feature minimizes leakage which might occur if the bulb receives a minor impact or compression, or is turned upside-down during handling and storage.

Although water is preferred as the liquid contained in the bulb and used for rinsing, other liquids known for use in rinsing the mouth, such as baby mouthwashes, etc. can be used instead. In either event, the caregiver is able to use pure and untainted liquids, and is able to dispense the liquids with one hand.

The foregoing and other objects and advantages of the invention will be set forth in or apparent from the following description and drawings.

IN THE DRAWINGS

FIG. 1 is a perspective view of an infant toothbrush constructed in accordance with the present invention;

FIG. 2 is a cross-sectional, partially broken-away, enlarged view taken along line 2-2 of FIG. 1;

FIG. 3 is a cross-sectional view taken along line 3-3 of FIG. 1;

FIG. 4 is a cross-sectional view similar to that of FIG. 3, showing another embodiment of the invention;

FIG. 5 is an enlarged, partially broken-away view of the upper edge portion of a component of the device shown in FIG. 4;

FIG. 6 is a broken-away, enlarged cross-sectional view of another embodiment of the invention;

FIG. 7 is a broken-away, bottom plan view of the structure shown in FIG. 6; and FIG. 8 is a schematic cross-sectional view of the structure of FIGS. 6 and 7 in an open operational condition.

DESCRIPTION

FIG. 1 is a perspective view of an infant toothbrush 10 forming one embodiment of the present invention. The device 10 includes a support structure in the form of a nipple. The support structure includes a relatively broad base portion 12 with a narrow mid-section 26, a narrow nipple portion with a tip 16, and a reduced neck portion 24. A rim or flange 22 around the bottom edge also is provided.

Secured to the support structure is a squeeze bottle or bulb 14.

A brush is formed of soft bristles 18 which extend around the entire periphery of the tip of the nipple. Although the bristles 18 are shown in FIG. 1 extending all the way around and on top of the nipple, it also is possible to provide them over a less extensive area, such as one half of the circumference of the nipple, or over other areas, as needed. The broad expanse of bristles makes it easier to apply the bristles to the infant's teeth.

Referring now to FIG. 3, as well as FIG. 1, the base structure has a central passageway 34 extending from a downwardly-extending projection 38 to an enlarged cavity 36 in the tip of the nipple. A plurality of holes 20 extend from the cavity 36 to the exterior of the nipple in the vicinity of the brush bristles 18. Five holes 20 are shown in the drawings, and eight holes would be used in the entire circumference of the nipple.

Although the holes 20 are shown arranged along a circumferential line, they also can be distributed over other parts of the nipple. Although eight holes 20 are used in the nipple shown, larger or smaller numbers of holes can be used so as to preferably provide a slow or moderate rate of flow of liquid into the infant's mouth.

The bulb 14 preferably has a high degree of elasticity. It has an upper opening with a rim which is fitted into an annular groove 39 around the projection 38. Preferably, the diameter D of the opening to the bulb (see FIG. 5 as well as FIG. 3), is made smaller than the diameter of the groove so that the opening of the bulb should be stretched to fit the rim into the groove and thus secure the bulb to the support with an interference fit.

A liquid 42 is placed in the bulb, and the bulb is attached to the base member. When the bulb 14 is squeezed, liquid will flow through the passageway 34 and the holes 20 to the mouth of the infant to rinse the teeth and the mouth. Preferably, relatively small amounts of liquid are used so as not to cause the infant to gag or choke.

Referring to FIG. 3, an outer cap 28 is provided. It is made with a circumferential groove 30 near its lower edge, which can be pressed down against the lip or flange 22 and snapped into place on top of the toothbrush assembly. This will keep the toothbrush hygienic, when carried in a purse, pocket or other receptacle.

The structure shown in FIG. 4 is the same as that shown in FIG. 3, except the bulb 44 has a different shape than the bulb 14. The bulb 44 is slimmer and holds less liquid 46, but may be easier and more comfortable for the caregiver to hold while brushing and rinsing the teeth.

FIG. 5 shows the upper edge of the bulb 44 (and is representative of the upper edge of the bulb 14) and shows the upper opening or entrance 47 and the ring 48 around its edge. Again, the diameter D is less than the diameter of the projection 38 in the groove 39 so that an interference fit is formed when the bulb is pressed against the projection 38.

The lower side walls of the projection 38 are angled so as to guide the projection into the inlet opening of the bulb.

The number and size of holes 20 which are used to dispense the liquid can be varied as desired. However, it is preferred that at least two holes be provided, preferably at widely-spaced points around the circumference of the nipple, so as to provide a plurality of liquid delivery points.

FIGS. 6, 7, and 8 show a valve structure which can be used in the structure shown in FIGS. 1-5 if needed to prevent leakage. A relatively thin, flexible membrane is provided at 50 to form a very simple valve covering the inlet to the passageway 34.

As it is shown in FIG. 7, the valve is formed by two slits 52 and 54 which cross one another at right angles in the vicinity of the end of the passageway. The membrane 50 is secured to the bottom surface of the projection 38.

The valve is set to prevent flow of liquid until a threshold pressure level is reached by squeezing the bulb. The valve is dimensioned and set to remain closed while the bulb 14 or 44 is turned upside down, or is slightly compressed or hit during normal handling and storage in a pocket or purse. Then, when strong compression is applied by squeezing the bulb, the valve opens, as shown in FIG. 8, to allow liquid to flow in the direction of the arrows 51.

The valve also may be set to retard back-flow of liquid from the passageway 34 into the bulb, if desired.

The materials of which the toothbrush 10 is made can be silicone rubber, latex or other sanitary, flexible, washable, dishwasher-proof substances now used for baby bottle nipples or other infant products. Preferably, the materials should be BPA-free.

The enlarged cavity 36 in the tip of the nipple can be made smaller than that shown to ensure that the nipple walls are thicker and the nipple is stiff enough to allow adequate scrubbing pressure to be used in brushing the infant's teeth. The nipple also preferably is soft enough to simulate an ordinary baby bottle nipple to comfort the infant. The wall thickness of the cavity 36 can be set to maintain both adequate stiffness and softness.

The material of the bulbs 14 and 44 preferably is transparent or translucent to allow the liquid level in the bulb to be visible.

The toothbrush and rinsing device shown and described above has a number of advantages.

First, shaping the support member like the nipple on a baby bottle is believed to soothe the infant and minimize protest. Thus, it is more likely that the infant is less resistant when the toothbrush is inserted into the infant's mouth. This can improve the cleansing process.

By distributing bristles around a substantial portion of the periphery of the nipple, it is relatively easy hold the bristles against the teeth to be brushed. Less hunting and delay is needed.

Providing the rinsing and wetting liquid in a bulb attached to the nipple is extremely helpful to the caregiver. The water or other liquid is readily at hand, and only one hand is needed to manipulate the toothbrush structure, thus leaving the other hand of the caregiver free to hold the infant, or perform other tasks.

Moreover, the water or other rinsing liquid can be carried with the toothbrush device in a pocket or purse, or in any other handy container while traveling away from the convenience of home. Sanitation is maintained, and leakage is minimized.

The above description of the invention is intended to be illustrative and not limiting. Various changes or modifications in the embodiments described may occur to those skilled in the art. These can be made without departing from the spirit or scope of the invention.

The invention claimed is:

1. A toothbrush intended for use in cleaning the teeth of infants, said toothbrush comprising, a. a nipple-shaped brush support comprising a relatively broad base with a narrower projection having a rounded tip, b. a brush made exclusively of soft infant toothbrush bristles extending from said rounded tip, c. a rinse liquid flow passageway having a side wall and extending through said base into said projection, d. at least one outlet opening in said side wall adjacent said brush for allowing fluid to flow out through said passageway, e. a resilient squeeze-bulb secured to said brush support, said bulb having a hollow interior containing a rinse liquid and communicating with said passageway in said brush support to conduct said liquid therethrough, and f. a valve comprising a flexible membrane with crossed slits across said passageway, said valve being adapted to close said passageway to restrict the flow of said rinse liquid from said bulb interior into said passageway until at least a threshold value of pressure is applied to squeeze said bulb.

2. A toothbrush as in claim 1 in which said base and said resilient bulb are secured together with a releasable friction coupling to permit said bulb and said base to be readily separated from and re-attached to one another.

3. A toothbrush as in claim 1 in which there are plurality of outlet openings in said passageway located in at least two points around the circumference of said rounded tip, in the vicinity of said bristles.

4. A toothbrush as in claim 1 in which said threshold value is high enough to assure that the liquid will not flow when said bulb has a liquid in it and is turned upside-down but is not squeezed.

5. A toothbrush as in claim 1 in which said brush support is made of soft, pliable material, said base has a downwardly extended surface and a flange at the base, and a downwardly-extending fastening projection with a groove around its base for snap-fastening said bulb to said brush support.

6. A toothbrush as in claim 1 including a releasable snap-fitting protective cap for covering said brush and said brush support, said base of said brush support having an outer rim and being made of resilient material, said cap having a lower edge with a circumferential groove adjacent to said lower edge, said groove being shaped to snap over said outer rim to hold said cap firmly in place with an interference fit.

7. A method of cleansing an infant's teeth, a. providing a toothbrush having a nipple-shaped brush support comprising a relatively broad base with a narrower projection having a rounded tip, with a passageway therethrough to said tip, a brush with bristles extending from said rounded tip, a fluid flow passageway having a side wall and extending through said base into said projection, at least one outlet opening in said side wall adjacent said brush for allowing fluid to flow out through said passageway, and a resilient bulb with a hollow interior connected to said passageway in said brush support in fluid-conducting relationship therewith, b. at least partially filling said bulb with a quantity of a rinsing liquid, c. brushing the infant's teeth with said brush, and d. rinsing said infant's teeth by squeezing said bulb to eject said rinsing liquid over said infant's teeth.

8. A method as in claim 7 in which said bristles extend for a substantial circumferential distance around said projection.

9. A method as in claim 7 in which said toothbrush includes a valve in the flow path between said interior of said bulb and said passageway to block the flow of liquid from said interior until pressure above a predetermined level is applied to said bulb, storing said toothbrush in a portable carrying receptacle and carrying it until needed.

* * * * *